US011767150B2

(12) United States Patent
Darst et al.

(10) Patent No.: US 11,767,150 B2
(45) Date of Patent: Sep. 26, 2023

(54) PILL CONTAINER AND METHODS

(71) Applicant: Apothecary Products, LLC, Burnsville, MN (US)

(72) Inventors: Daniel Darst, Zimmerman, MN (US); Jennifer Joy Kallemeyn, Savage, MN (US)

(73) Assignee: Apothecary Products, LLC, Burnsville, MN (US)

( * ) Notice: Subject to any disclaimer, the term of this patent is extended or adjusted under 35 U.S.C. 154(b) by 0 days.

(21) Appl. No.: 17/514,464

(22) Filed: Oct. 29, 2021

(65) Prior Publication Data

US 2022/0135292 A1 May 5, 2022

Related U.S. Application Data

(60) Provisional application No. 63/107,817, filed on Oct. 30, 2020.

(51) Int. Cl.

| | |
|---|---|
| ***B65D 50/04*** | (2006.01) |
| ***B65D 47/26*** | (2006.01) |
| ***B65D 83/04*** | (2006.01) |

(52) U.S. Cl.

CPC ..... *B65D 50/046* (2013.01); *B65D 47/265* (2013.01); *B65D 83/0481* (2013.01); *B65D 2215/02* (2013.01); *B65D 2583/04* (2013.01)

(58) Field of Classification Search

CPC ..... B65D 1/24; B65D 1/36; B65D 2585/56; B65D 50/00–046; B65D 47/00–265; B65D 83/00–0481; B65D 2215/02; B65D 2583/04; A61J 7/0084

See application file for complete search history.

(56) References Cited

U.S. PATENT DOCUMENTS 2,978,285 A * 4/1961 Jester ..... A47F 5/02 220/555
3,326,360 A * 6/1967 Lyon, Jr. ..... B65D 83/0454 206/533
3,334,731 A * 8/1967 Dale ..... A61J 7/04 206/534
3,896,968 A * 7/1975 Pehr ..... B65D 83/0427 206/535
4,057,145 A 11/1977 Wray et al.
4,164,301 A * 8/1979 Thayer ..... B65D 83/0454 292/84
4,548,331 A * 10/1985 Montgomery ..... B65D 50/045 220/253

(Continued)

FOREIGN PATENT DOCUMENTS

EP 1053955 A2 11/2000
WO 2019007799 A1 1/2019

OTHER PUBLICATIONS

International Search Report and Written Opinion for PCT/US2021/057409 dated Feb. 24, 2022, 14pgs.

*Primary Examiner* — Kareen K Thomas
(74) *Attorney, Agent, or Firm* — Merchant & Gould P.C.

(57) ABSTRACT

A child resistant pill container includes a base having individual compartments. A lid rotatably fits over the base and has a closed cover defining one open section. A releasable lock arrangement is between the base and the lid. The lid can be rotated relative to the base to position the open section in the lid over one of the individual compartments in the base.

16 Claims, 5 Drawing Sheets

(56) References Cited

U.S. PATENT DOCUMENTS

| | | | | |
|---|---|---|---|---|
| 4,572,376 | A * | 2/1986 | Wrennall | A61J 7/04 220/253 |
| 4,653,668 | A * | 3/1987 | Gibilisco | B65D 83/0409 221/289 |
| 5,782,359 | A | 7/1998 | McAllister et al. | |
| 6,631,805 | B2 | 10/2003 | Bremen | |
| 7,648,041 | B2 * | 1/2010 | Ueda | H01L 21/67126 220/323 |
| D850,782 | S | 6/2019 | Lee et al. | |
| 10,420,703 | B1 | 9/2019 | Lee | |
| 11,161,665 | B2 * | 11/2021 | McDonald | B65D 75/367 |
| 2003/0205496 | A1 | 11/2003 | Howard et al. | |
| 2005/0205595 | A1 | 9/2005 | Lepke et al. | |
| 2007/0261985 | A1 | 11/2007 | Allen | |
| 2009/0114562 | A1 | 5/2009 | Noble et al. | |
| 2011/0101018 | A1 | 5/2011 | Shafir | |
| 2013/0056385 | A1 | 3/2013 | Thompson et al. | |
| 2014/0251863 | A1 | 9/2014 | Priebe et al. | |

* cited by examiner

PILL CONTAINER AND METHODS

CROSS-REFERENCE TO RELATED APPLICATION

This application claims the benefit of U.S. Provisional Patent Application No. 63/107,817, filed Oct. 30, 2020, which is incorporated by reference herein in its entirety.

TECHNICAL FIELD

This disclosure relates generally to containers used for holding medicine, such as pills. In particular, this disclosure relates to containers having child resistant features and methods of opening such containers.

BACKGROUND

Containers for holding pills are well known. Some containers can include multiple compartments. See, for example, commonly assigned U.S. Pat. No. 7,624,890, incorporated herein by reference.

When these containers hold medicine or vitamins, it is helpful to have features that will not allow a child to easily access the contents, for safety reasons. While there are pill containers that are considered child-deterrent, improvements are desirable for containers that are child resistant per the standard of US 16 CFR 1700.15.

SUMMARY

In general, this disclosure is directed to pill containers that are an improvement over the prior art.

In one aspect, a child resistant pill container is provided including a base and a lid. The base includes (i) a floor; (ii) a round circumferential outer wall extending from the floor and defining an internal volume; (iii) a central base hub extending from the floor; and (iv) a plurality of dividing partitions extending from base hub to the outer wall, dividing the internal volume into a plurality of individual compartments. The lid is sized to rotatably fit over the base and includes (i) a closed cover defining one open section; (ii) a round circumferential outer frame extending from the cover in a direction toward the base and sized to circumscribe the outer wall of the base; and (iii) a central lid hub extending from the cover; the lid hub being sized to interlock with the base hub. A releasable lock arrangement is between the base and the lid. The lid can be rotated relative to the base to position the open section in the lid over one of the individual compartments.

Example embodiments include a biasing arrangement between the base and lid, biasing the lid away from the base.

In examples, the biasing arrangement comprises a projecting ring slidably mounted on an opposing flanged ring; the projecting ring being on one of the base and lid, and the flanged ring being on the other of the base and lid.

In examples, the projecting ring extends from the cover and circumscribes the lid hub; and the flanged ring extends from the floor of the base and is part of the base hub.

The releasable lock arrangement can include a plurality of tabs on one of the base and lid, and a plurality of receivers on the other of the base and lid.

In many embodiments, (a) the tabs project radially inwardly from the outer frame of the lid; and (b) the receivers include a plurality of radially outward extending bosses extending from the outer wall of the base, the bosses each defining an axially oriented notch sized to engage with one of the tabs.

In some examples, (a) each individual compartment is pie sector shaped; and (b) the open section of the cover being pie sector shaped.

There is no more than one open section in the cover; and the open section is about a same size and shape as each individual compartment, in example arrangements.

In many embodiments, there are 7 individual compartments.

For some examples, (a) the base hub includes a flanged ring projecting from the floor and having radially inward extending hooks; and (b) the lid hub includes a flanged ring with a diameter smaller than the flanged ring of the base hub; the flanged ring of the lid hub having radially outward extending hooks engaged with the radially inward extending hooks of the base hub.

In one or more embodiments, the base is a single molded piece of material; and the lid is a single molded piece of material.

In another aspect, a method of accessing contents of a pill container is provided. The method includes pushing a round lid against a spring force toward a round base to release a lock between the lid and the base; and while the lock is released, continuing to apply a pushing force on the lid while rotating the lid relative to the base to move an open section in a cover of the lid to be over an individual compartment in the base.

In one example method, after the step of rotating the lid, there is a step of releasing the pushing force on the lid to allow the spring force to move the lid away from the base and re-engage the lock between the lid and the base.

Example methods include using a base having: (a) a floor; (b) a round circumferential outer wall extending from the floor and defining an internal volume; (c) a central base hub extending from the floor; and (d) a plurality of dividing partitions extending from base hub to the outer wall, dividing the internal volume into a plurality of individual compartments.

Example methods include using a lid having: (a) a closed cover defining the open section; (b) a round circumferential outer frame extending from the cover in a direction toward the base and sized to circumscribe the outer wall of the base; and (c) a central lid hub extending from the cover; the lid hub being sized to interlock with the base hub.

A variety of examples of desirable features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Pill containers described herein have a locking mechanism that meets a child-resistant protocol, as specified in Federal Regulations, such as 16 CFR 1700.15. The pill containers have a secure closure to avoid compartments opening or spilling when dropped. They are easy to open for those with dexterity issues (Ease of Use from Arthritis Foundation). They are made from food-grade, BPA plastic. They last through multiple uses without breaking.

Figure 1:
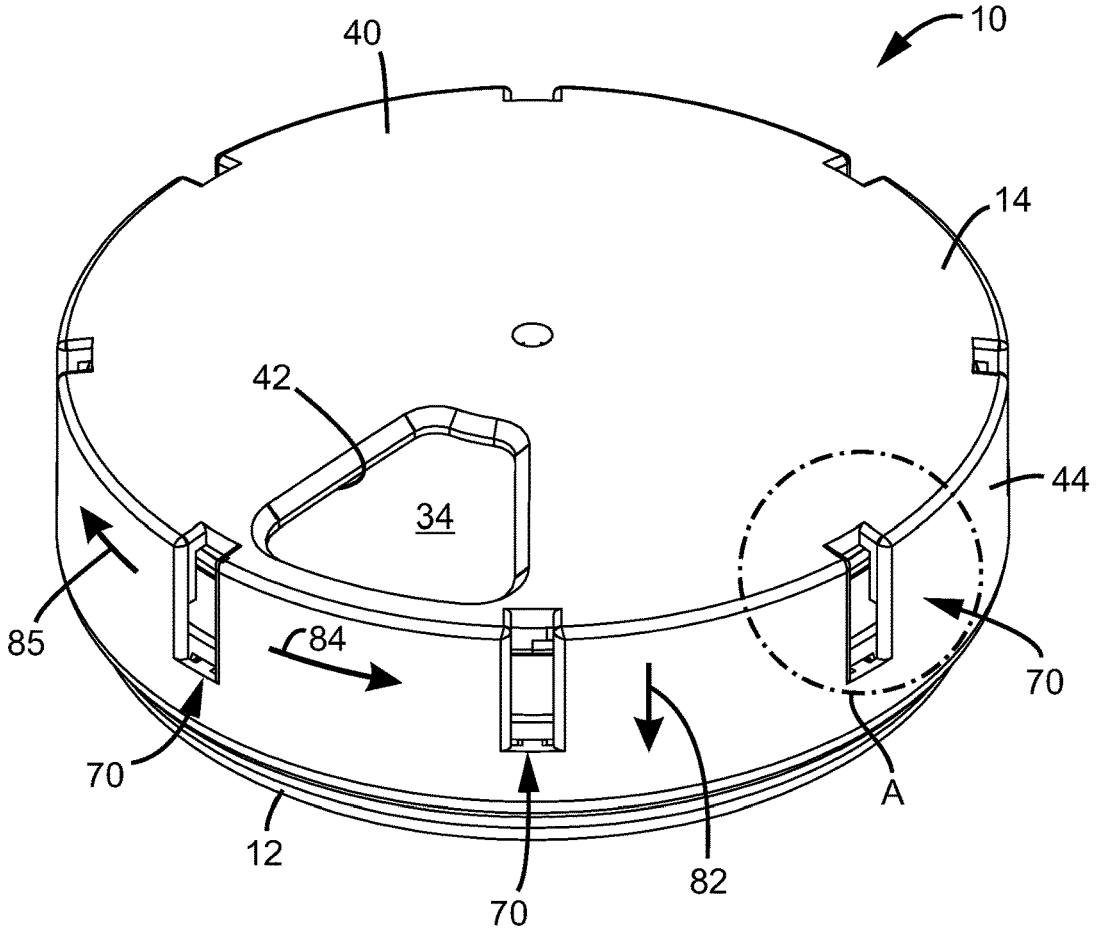
FIG. 1 is a top perspective view of an embodiment of a pill container in the closed position, constructed in accordance with principles of this disclosure.
Figure 2:
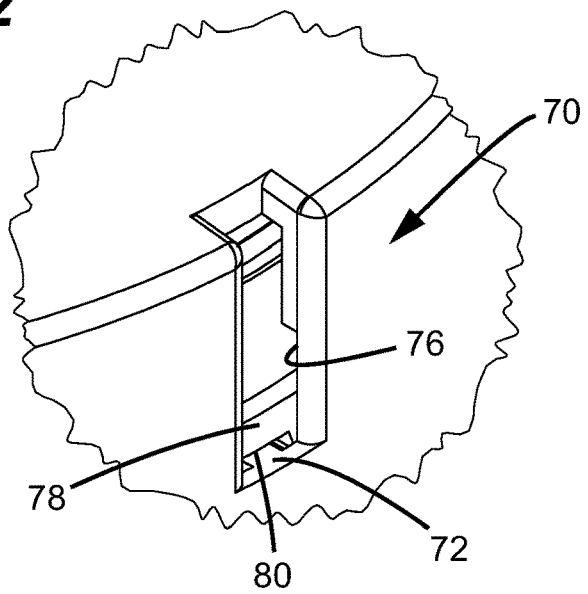
FIG. 2 is an enlarged view of portion A, depicted in FIG. 1.
Figure 3:
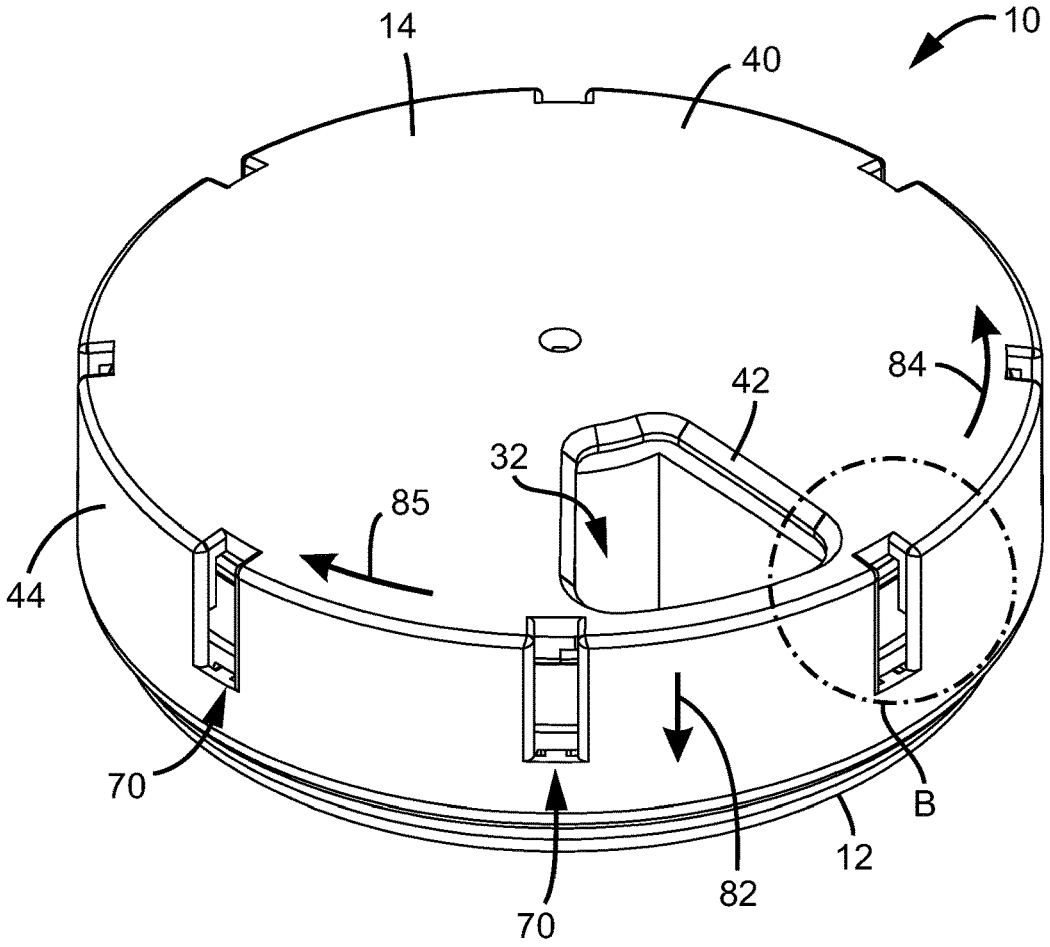
FIG. 3 is a top perspective view of the pill container of FIG. 1, but showing the container in one of the open positions.
Figure 4:
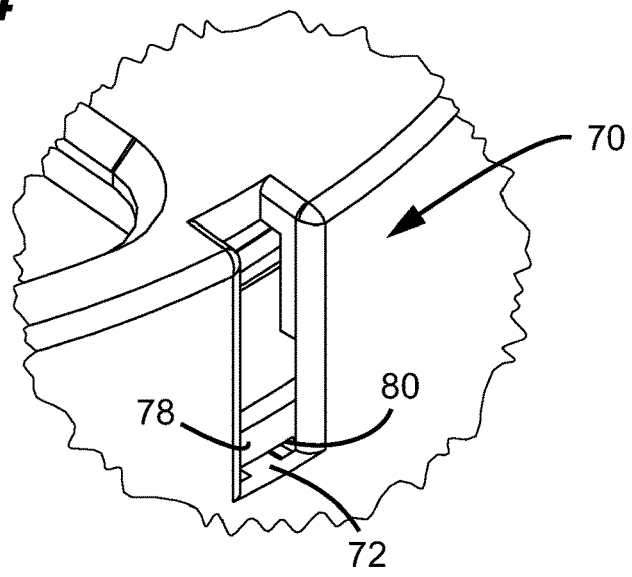
FIG. 4 is an enlarged view of portion B, depicted in FIG. 3.

FIG. 1 is a perspective view of a child resistant pill container 10, constructed in accordance with principles of this disclosure. In the embodiment of FIG. 1, the container 10 is shown in a closed position, while in the embodiment of FIG. 3, the container 10 is shown in an open position. By the term "closed position", it is meant that there is no access to any of the contents of the container 10. By "open position", it is meant that the user does have access to the contents of the container 10.

Figure 5:
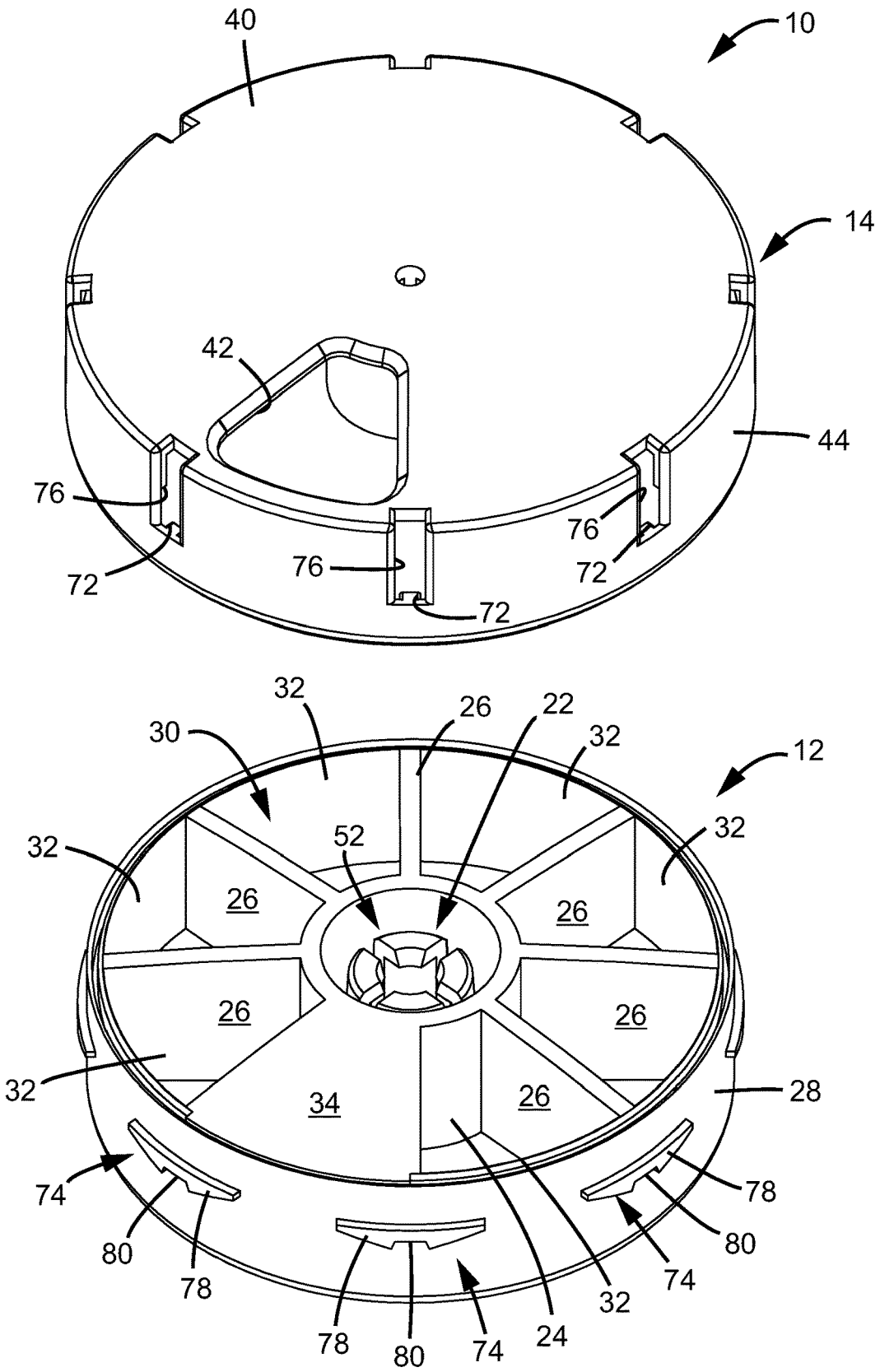
FIG. 5 is a top, perspective exploded view of the pill container of FIG. 1.
Figure 6:
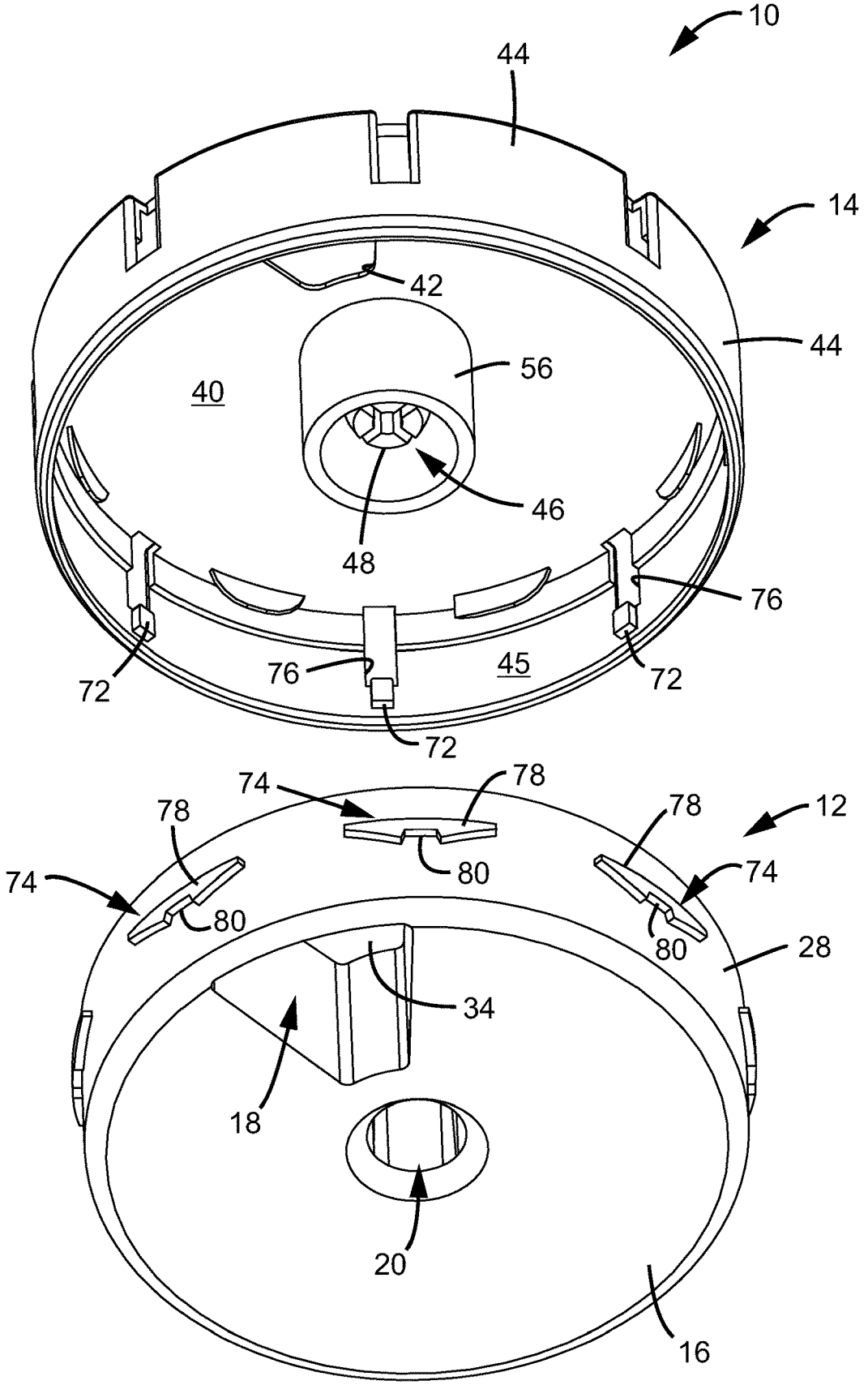
FIG. 6 is a bottom, perspective exploded view of the pill container of FIG. 1.
Figure 7:
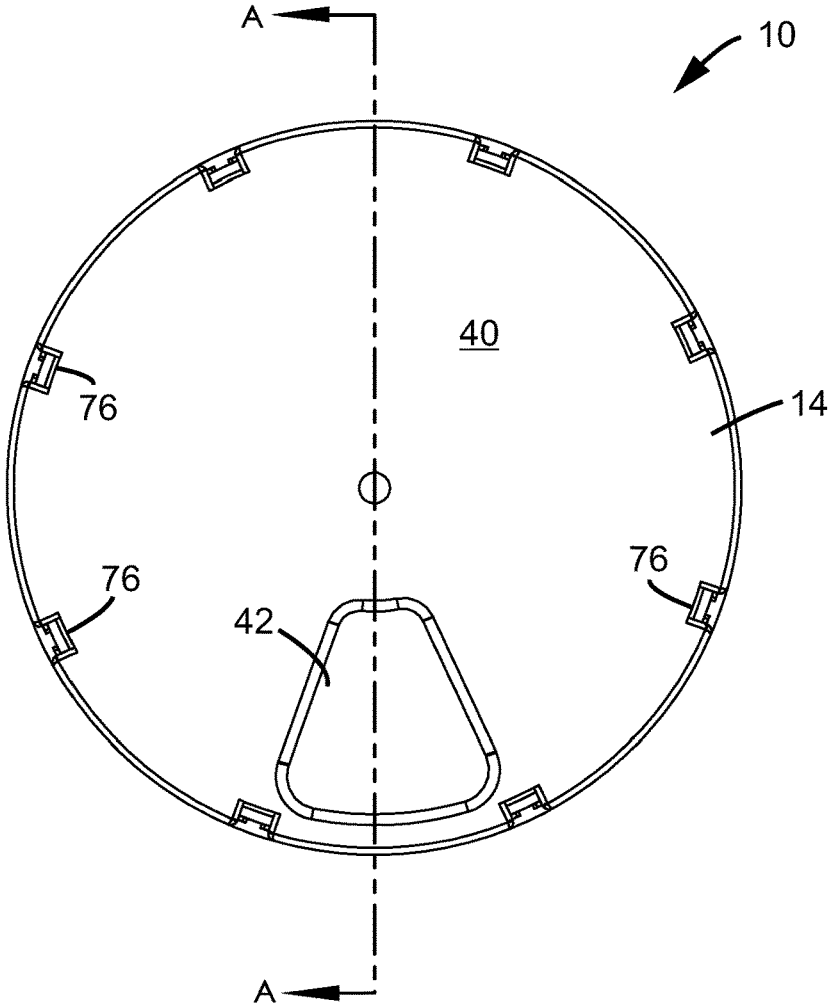
FIG. 7 is a top plan view of the pill container of FIG. 1.

The container 10 includes a base 12 and a lid 14 (see FIGS. 5 and 6). The lid 14 is sized to rotatably fit over the base 12, such that the lid 14 can be rotated relative to the base 12 to position and open section of the lid 14 over an individual pill compartment in the base 12. Arrows of rotation are shown in FIG. 1 at 84, 85.

In reference now to FIGS. 5 and 6, the base 12 includes a floor 16. The floor 16 is generally solid and continuous, with the exception of a recess 18 formed therein. The recess 18 terminates at the upper plane of the base 12 at a closed section 34. At the center of the floor 16 is an opening 20 that extends into a central hub 22 having a flanged ring 52. The hub 22 extends from the floor 16. The hub 22 includes an inner surrounding wall 24, which surrounds and circumscribes the flanged ring 52.

Extending from the inner wall 24, which is part of the hub 22, are dividing spokes or partitions 26. The partitions 26 extend from the inner wall 24 of the hub 22 to an outer wall 28. The outer wall 28 is a round, circumferential outer wall 28 extending from the floor 16 and defining an internal volume 30. The partitions 26 divide the internal volume 30 into a plurality of individual compartments 32. The compartments 32 are sized to hold contents, such as pills, vitamins, or any of a variety of miscellaneous things.

The compartments 32 are circumferentially disposed about the hub 22. In the example shown, each compartment 32 is pie sector shaped. In the example shown, there are seven individual compartments 32, one for each day of the week. Other embodiments can include more or fewer compartments 32, and can include differently shaped compartments 32.

As mentioned above, the base 12 further includes closed section 34. The closed section 34 has the same perimeter shape as the compartments 32, which in this example, are pie sector shaped. The closed section 34 is circumferentially positioned between two adjacent compartments 32.

Still in reference to FIGS. 5 and 6, the lid 14 is depicted. The lid 14 includes a closed cover 40 defining at least one open section 42. The open section 42 can have many shapes, but in the example shown, has the same shape as the shape of the compartments 32, which is shown as pie sector shaped. Further, the open section 42 is about a same perimeter size as the perimeter of each compartment 32. Other variations are possible. In this example, there is no more than one open section 42 in the cover 40.

The lid 14 further includes a round circumferential outer frame 44. The frame 44 extends from the cover 40 in a direction toward the base 12 and is sized to overlap, surround, and circumscribe the outer wall 28 of the base 12.

Extending from the cover 40 is a central lid hub 46 (FIG. 6). The lid hub 46 is sized and shaped to interlock with the base hub 22. While many variations are possible, in the example shown, the interlocking hubs 22, 46 have hooks, as described below.

Figure 8:
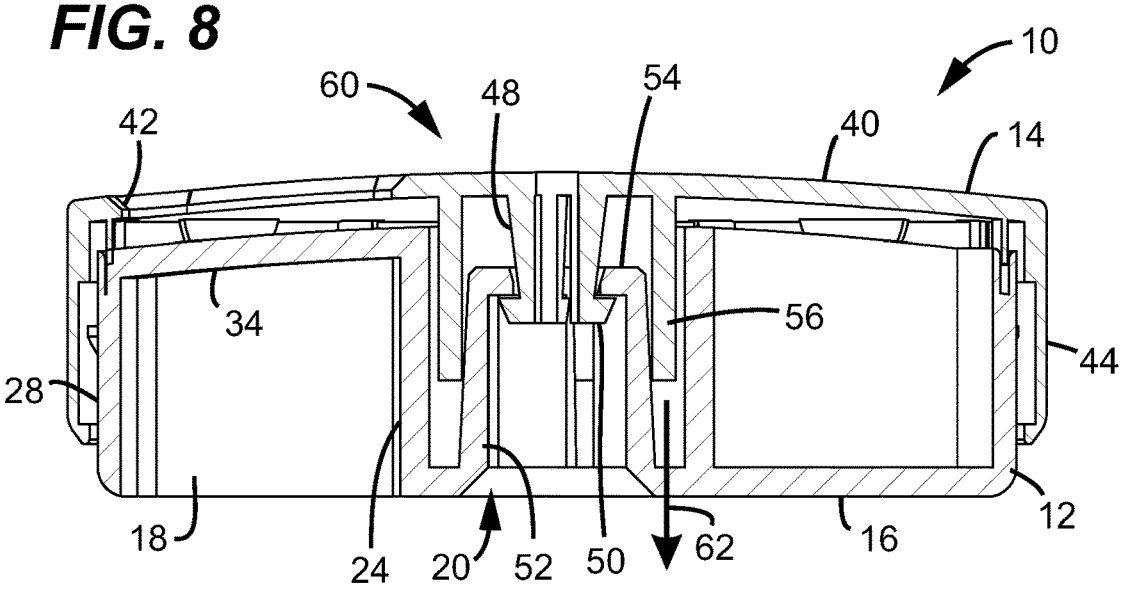
FIG. 8 is a cross-sectional view of the pill container of FIG. 1, the cross-section being taken along the line A-A of FIG. 7.

The lid hub 46 includes a flanged ring 48 having radially outward extending hooks 50 (FIG. 8). The flanged ring 52 of the base hub 22 has radially inward extending hooks 54. As can be seen in FIG. 8, the diameter of the flanged ring 48 of the lid hub 46 is smaller than the diameter of the flanged ring 52 of the base hub 22. The hooks 50 engage the hooks 54, which prevent separation of the lid 14 from the base 12, while allowing for relative rotation between the base 12 and the lid 14. As can be seen in FIG. 6, the flanged ring 48 of the cover 40 is surrounded or circumscribed by an inner wall 56.

The pill container 10 includes a biasing arrangement 60 (FIG. 8). The biasing arrangement 60 is between the base 12 and lid 14, and functions as a spring, to bias the lid 14 in a direction away from the base 12.

Many different arrangements are possible, and in this example embodiment, the biasing arrangement 60 includes the ring 56 slidably mounted on the opposing flanged ring 52. In the example shown, the projecting ring 56 is on the lid 14, while the flanged ring 52 is on the base 12, but this could be reversed in other embodiments. Because of the relative diameter between the ring 56 and flanged ring 52, as the ring 56 is moved in a downward direction, shown at arrow 62 toward the base 12, it will have increased interference as it slides against the slightly angled flanged ring 52. This interference will cause the lid 14 to be biased or urged upwardly, away from the interfering surfaces of the ring 56 and flanged ring 52. However, the lid 14 can be forced by a downward motion in the direction of 62 to move the lid 14 toward the base 12.

The container 10 further includes a releasable lock arrangement 70. The lock arrangement 70 is between the base 12 and lid 14. The releasable lock arrangement 70 can be embodied in many different forms, and in one example includes a plurality of tabs 72 and a plurality of receivers 74. The tabs 72 can be on either the base 12 or lid 14, while the receivers 74 can be on the other of the base 12 and lid 14.

In the example shown, the tabs 72 project radially inwardly from an inside surface 45 (FIG. 6) of the outer frame 44 of the lid 14. The tabs 72 are located at a base of an open slot 76. The slots 76 and tabs 72 are circumferentially spaced about the outer frame 44, and in the example shown, are evenly circumferentially spaced.

The receivers 74 include a plurality of radially outward extending bosses 78 extending from the outer wall 28 of the base 12. The bosses 78 are shown as evenly circumferentially spaced about the wall 28. Each of the bosses 78 define an axially oriented notch 80 sized to receive or engage with one of the tabs 72. Each of the notches 80 is oriented downwardly, in a direction toward the floor 16

It should be understood that the biasing arrangement 60 is biased to keep the tabs 72 in a respective one of the notches 80.

In use, the pill container 10 can be used by pushing the lid 14 against the spring force, in the form of the bias arrangement 60, toward the base 12 to release the lock arrangement 70 between the lid 14 and the base 12. This pushing force will move the lid 14 in a downward direction 82 (FIG. 1), which will move the tabs 72 from engagement with one of the notches 80.

Next, while the lock arrangement 70 is released, the pushing force is continued to be applied on the lid 14 while rotating the lid 14 relative to the base 12. In FIG. 1, the arrows 84 and 85 show the motion of rotation, either in the counter clockwise direction of 84 or the clockwise direction of 85. This rotating motion will move the open section 42 in the cover 40 of the lid 14 to be over one of the individual compartments 32 in the base 12.

After rotating the lid 14, the pushing force can be released from the lid 14, which will allow the spring force or biasing arrangement 60 to move the lid 14 away from the base 12 and reengage the lock arrangement 70 between the lid 14 and the base 12. The user may access the contents of the individual compartment 12, exposed by the open section 42. The user may again apply a pushing force against the lid 14 to unlock the lock arrangement 70 and again rotate the lid 14 relative to the base 12 to expose either another compartment 32, or to return the open section 42 to be over the closed section 34 of the base 12, closing the container 10.

The base 12 can be made from a molded plastic in a single, molded piece. The lid 14 can also be made from a molded plastic in a single, molded piece.

The above represents example principles. Many embodiments can be made using these principles.

What is claimed is:

1. A child resistant pill container comprising:

(a) a base including:

(i) a floor;

(ii) a round circumferential outer wall extending from the floor and defining an internal volume;

(iii) a central base hub extending from the floor;

(iv) a plurality of dividing partitions extending from base hub to the outer wall, dividing the internal volume into a plurality of individual compartments;

(b) a lid sized to rotatably fit over the base, the lid including:

(i) a closed cover defining one open section;

(ii) a round circumferential outer frame extending from the cover in a direction toward the base and sized to circumscribe the outer wall of the base;

(iii) a central lid hub extending from the cover; the lid hub being sized to interlock with the base hub;

(c) a releasable lock arrangement between the base and the lid;

wherein the lid can be rotated relative to the base to position the open section in the lid over one of the individual compartments; and (d) a biasing arrangement between the base and lid, biasing the lid away from the base.

2. The pill container of claim 1 wherein the biasing arrangement comprises a projecting ring slidably mounted on an opposing flanged ring; the projecting ring being on one of the base and lid, and the flanged ring being on the other of the base and lid.

3. The pill container of claim 2 wherein the projecting ring extends from the cover and circumscribes the lid hub; and the flanged ring extends from the floor of the base and is part of the base hub.

4. The pill container of claim 1 wherein the releasable lock arrangement includes a plurality of tabs on one of the base and lid, and a plurality of receivers on the other of the base and lid.

5. The pill container of claim 4 wherein:

(a) the tabs project radially inwardly from the outer frame of the lid; and (b) the receivers include a plurality of radially outward extending bosses extending from the outer wall of the base, the bosses each defining an axially oriented notch sized to engage with one of the tabs.

6. The pill container of claim 1 wherein:

(a) each individual compartment is pie sector shaped; and (b) the open section of the cover being pie sector shaped.

7. The pill container of claim 6 wherein:

(a) there is no more than one open section in the cover; and (b) the open section is about a same size and shape as each individual compartment.

8. The pill container of claim 1 wherein there are 7 individual compartments.

9. The pill container of claim 1 wherein:

(a) the base hub includes a flanged ring projecting from the floor and having radially inward extending hooks; and (b) the lid hub includes a flanged ring with a diameter smaller than the flanged ring of the base hub; the flanged ring of the lid hub having radially outward extending hooks engaged with the radially inward extending hooks of the base hub.

10. The pill container of claim 1 wherein:

(a) the base is a single molded piece of material; and (b) the lid is a single molded piece of material.

11. A child resistant pill container comprising:

(a) a base including:

(i) a floor;

(ii) a round circumferential outer wall extending from the floor and defining an internal volume;

(iii) a central base hub extending from the floor;

(iv) a plurality of dividing partitions extending from base hub to the outer wall, dividing the internal volume into a plurality of individual compartments;

(b) a lid sized to rotatably fit over the base, the lid including:

(i) a closed cover defining one open section;

(ii) a round circumferential outer frame extending from the cover in a direction toward the base and sized to circumscribe the outer wall of the base;

(iii) a central lid hub extending from the cover; the lid hub being sized to interlock with the base hub;

(c) a releasable lock arrangement between the base and the lid;

(i) the lid being rotatable relative to the base to position the open section in the lid over one of the individual compartments;

(ii) the releasable lock arrangement including a plurality of tabs and receivers; the tabs projecting radially inwardly from the outer frame of the lid; and (iii) the receivers including a plurality of radially outward extending bosses extending from the outer wall of the base, the bosses each defining an axially oriented notch sized to engage with one of the tabs.

12. The pill container of claim 11 wherein:

(a) each individual compartment is pie sector shaped; and (b) the open section of the cover being pie sector shaped.

13. The pill container of claim 12 wherein:

(a) there is no more than one open section in the cover; and (b) the open section is about a same size and shape as each individual compartment.

14. The pill container of claim 11 wherein there are 7 individual compartments.

15. The pill container of claim 11 wherein:

(a) the base hub includes a flanged ring projecting from the floor and having radially inward extending hooks; and (b) the lid hub includes a flanged ring with a diameter smaller than the flanged ring of the base hub; the flanged ring of the lid hub having radially outward extending hooks engaged with the radially inward extending hooks of the base hub.

16. The pill container of claim 11 wherein:

(a) the base is a single molded piece of material; and (b) the lid is a single molded piece of material.

* * * * *